US009335094B2

(12) United States Patent
Brush et al.

(10) Patent No.: US 9,335,094 B2
(45) Date of Patent: May 10, 2016

(54) ENGINE EXHAUST-DRIVEN HEATING DEVICE FOR USE IN PORTABLE SURFACE DRYING EQUIPMENT

(71) Applicant: Green Flag Surface Tech Inc., Tecumseh (CA)

(72) Inventors: Robert Brush, Tecumseh (CA); John W. Robinson, Jr., Bloomer, WI (US)

(73) Assignee: Green Flag Surface Tech, Inc., Tecumseh, Ontario (CA)

( * ) Notice: Subject to any disclaimer, the term of this patent is extended or adjusted under 35 U.S.C. 154(b) by 0 days.

(21) Appl. No.: 14/672,475

(22) Filed: Mar. 30, 2015

(65) Prior Publication Data

US 2016/0010918 A1 Jan. 14, 2016

Related U.S. Application Data

(60) Provisional application No. 61/971,675, filed on Mar. 28, 2014.

(51) Int. Cl.

| | |
|---|---|
| ***F01N 5/02*** | (2006.01) |
| ***F26B 23/00*** | (2006.01) |
| ***F01N 3/10*** | (2006.01) |
| ***F26B 3/02*** | (2006.01) |
| *F01N 1/08* | (2006.01) |
| *F26B 23/02* | (2006.01) |
| *F01N 3/28* | (2006.01) |
| *F01N 13/00* | (2010.01) |
| *F01N 13/08* | (2010.01) |
| *F01N 3/30* | (2006.01) |

(52) U.S. Cl.

CPC ..... *F26B 23/001* (2013.01); *F01N 3/10* (2013.01); *F01N 5/02* (2013.01); *F26B 3/02* (2013.01); *F01N 1/083* (2013.01); *F01N 3/2882* (2013.01); *F01N 3/30* (2013.01); *F01N 13/002* (2013.01); *F01N 13/08* (2013.01); *F01N 2270/04* (2013.01); *F01N 2270/10* (2013.01); *F01N 2590/06* (2013.01); *F26B 23/024* (2013.01)

(58) Field of Classification Search

CPC ..... F01N 1/083; F01N 3/10; F01N 3/2882; F01N 3/30; F01N 3/32; F01N 3/34; F01N 5/02; F01N 13/002; F01N 13/08; F01N 2270/04; F01N 2270/10; F01N 2590/06; F26B 23/001; F26B 23/002; F26B 23/024

USPC ..... 60/274, 299, 307, 317, 320, 324

See application file for complete search history.

(56) References Cited

U.S. PATENT DOCUMENTS 8,281,499 B2 10/2012 Friesen et al.

*Primary Examiner* — Jorge Leon, Jr.

(74) *Attorney, Agent, or Firm* — GableGotwals

(57) ABSTRACT

An engine exhaust-driven heating device generates a high volume, steady stream of hot gas by passing an exhaust stream from a gasoline, propane, natural gas, or combustible fueled internal combustion engine through a catalyst that reduces the atmospheric emissions of the stream and liberates the energy of the pollutants in the stream. The device then combines the catalytic-treated air stream with a fresh air stream to further react with remaining pollutants and generate additional heat. The hot gas may be used to dry a variety of surfaces and, when integrated without other components typically found in surface drying equipment, provides an ideal system for use in a variety of moderate- to large-sized portable surface drying equipment. The heating device provides a reliable and continuous heat source and, when integrated into a controlled delivery system, dries the moisture from a surface faster and more effectively than prior art heating devices.

19 Claims, 3 Drawing Sheets

ENGINE EXHAUST-DRIVEN HEATING DEVICE FOR USE IN PORTABLE SURFACE DRYING EQUIPMENT

CROSS-REFERENCE TO CO-PENDING APPLICATIONS

This application claims the benefit of U.S. Prov. Appl. Ser. No. 61/971,675 filed Mar. 28, 2014, the content of which is hereby incorporated by reference.

BACKGROUND OF THE INVENTION

This invention generally relates to heating devices used in drying equipment. More particularly, the invention relates to heating devices used in drying equipment that make use of an exhaust gas stream from a gasoline, propane, natural gas, or combustible fueled internal combustion engine as a means of generating heat for dissipating and evaporating moisture from a surface.

Any variety of commercial tasks, endeavors or public events can be delayed for indefinite periods of time while waiting for natural evaporation to occur after a moisture-generating event (e.g., dew, mist, rain, frost, snow, plumbing failures).

Prior art drying equipment either extracts moisture from the surface-to-be-dried (see e.g., U.S. Pat. No. 8,281,499 B2) or generates a stream of heated air to dry the surface. The heated air stream is usually achieved by the use of a heating device having an open flame or electric-resistance heater, infrared combustion of an air/fuel mixture, or infrared radiation from electric lighting such as a halogen or other high intensity lamp. Air is passed over, around or through the heating device using one of these techniques and then the heated air is directed as needed.

The disadvantages of drying equipment that makes use of prior art heating devices include (1) lack of mobility or portability and a limited ability to access all surface areas with the heated air stream; (2) safety hazards posed by the device to users and bystanders; (3) complex design with an associated higher operating and maintenance cost; (4) a limited lifespan of the heating source and an inability of the heat source to withstand rough handling and service; (5) a need to be connected to a main source of high amperage electrical power; and (6) limitations on the amount of heated air that can be generated due to the engineering constraints of the materials from which the heating device is constructed.

SUMMARY OF THE INVENTION

An engine exhaust-driven heating device made according to this invention generates a high volume, steady stream of hot gas by passing an exhaust stream from a gasoline, propane, natural gas, or combustible fueled internal combustion engine through a catalyst that reduces the atmospheric emissions of the stream and liberates the energy of the pollutants in the stream, and then combining that catalytic-treated air stream with a fresh air stream to further react with remaining pollutants and generate additional heat. The hot gas may be used to dry a variety of surfaces and, when integrated without other components typically found in surface drying equipment, provides an ideal system for use in a variety of moderate- to large-sized portable surface drying equipment. The heating device provides a reliable and continuous heat source and, when integrated into a controlled delivery system, dries the moisture from a surface faster and more effectively than prior art heating devices.

In a preferred embodiment of the portable heating system, a catalytic chamber which houses at least one catalyst for treating engine emission pollutants is arranged to receive an exhaust gas stream from an engine, preferably being run in a fuel-rich condition. The exhaust gas stream passes through the catalyst, which can be arranged in one or more stages, into a baffled mixing chamber arranged to receive the catalytic-treated exhaust gas stream. The baffled mixing chamber mixes the catalytic-treated exhaust gas stream with an ambient air stream to produce a cleaner and higher temperature mixed gas stream. A distribution chamber is arranged to receive the mixed gas stream and direct it toward a surface to be dried or stripped of an unwanted layer of material.

The system can include a pressurized air source arranged in communication with the catalytic chamber for injecting pressurized air into the chamber. The pressurized air—which could be pure oxygen and preferably has a greater percentage of oxygen than the ambient air stream (which is typically about 21% oxygen at sea level but varies according to altitude)—can be arranged to inject the pressurized air ahead of the catalyst.

In a preferred embodiment of the portable heating apparatus a baffled mixing chamber is located downstream of a catalytic chamber that at least one catalyst suitable for reducing a level of undesired pollutants present in an engine exhaust gas stream. A source of pressurized air, which could be pure oxygen, can be included to inject pressurized air into the chamber, ahead of the catalyst in the chamber. The baffled mixing chamber receives the catalytic-treated exhaust gas stream and mixes it with an ambient air stream. The ambient air stream can be provided by a blower. A distribution chamber then takes this cleaner, higher temperature mixed gas stream and directs its flow, preferably downward through a perforated plate.

In a preferred embodiment of a method for removing an undesired layer of material residing immediately above a desired base layer of material (e.g., water on a road, ice on a sidewalk) includes the steps of:

- passing an engine exhaust gas stream through a catalytic chamber housing at least one catalyst; the catalyst being suitable for reducing a level of undesired pollutants present in the engine exhaust gas stream;
- mixing a catalytic-treated exhaust gas stream from the catalytic chamber with an ambient air stream from an ambient air source, the mixing step taking place in a baffled mixing chamber (5); and
- distributing a mixed gas stream from the baffled mixing chamber toward the undesired layer of material.

The method can also include the step of injecting pressurized air into the engine exhaust gas stream, and this pressurized air can be pure oxygen or contain a greater percentage of oxygen than does the ambient air. The method results in the mixed gas stream having a higher temperature and overall lower level of pollutants than the catalytic-treated exhaust gas stream and the catalytic-treated exhaust gas stream having a higher temperature and overall lower level of pollutants than the engine exhaust gas stream.

Objects of this invention include providing a heating device that (1) contains and controls a catalytic reaction of combustible exhaust gases; (2) uses the catalytic-reacted gas as a heat source; (3) uses fewer components and is less complex than prior art devices; (3) is portable and able to integrate into a range of equipment sizes best suited for a user application; (5) is easy to operate and maintain; (6) has minimal environmental impact; (7) is safer than prior art devices; and (8) creates a very cost effective choice relative to prior art surface drying technology.

ELEMENTS AND NUMBERING USED IN THE DRAWING FIGURES

Figure 1:
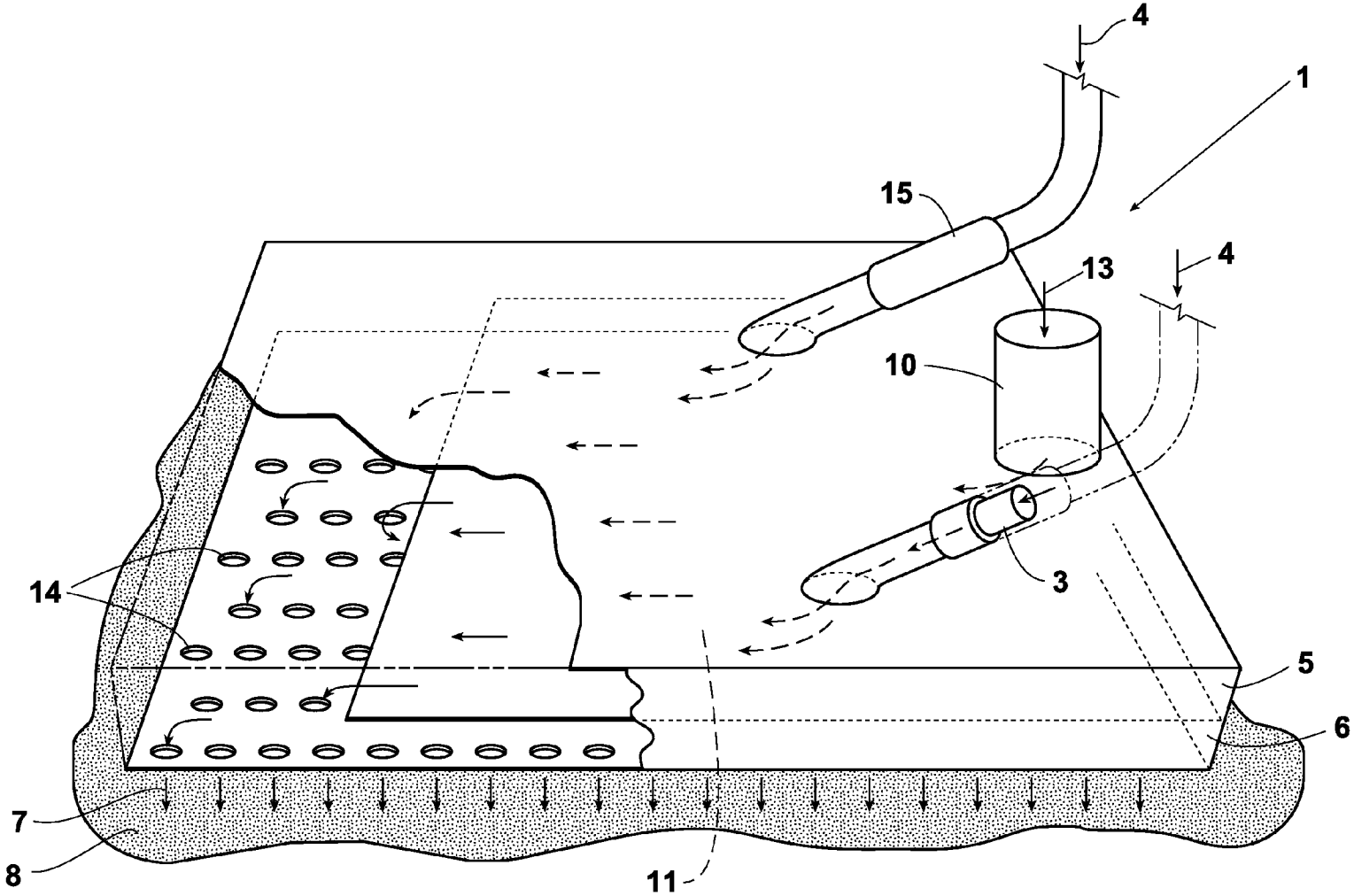
FIG. 1 is a perspective view of a preferred embodiment of a catalytic heat distribution chamber according to this invention. An exhaust stream from an engine enters a dual catalytic heater plenum where the stream is mixed with a fresh ambient air stream. A lower distribution chamber dispenses the hot or heated air.

1 Dual catalytic heater plenum
2 Multiple catalytic heater plenum
3 Catalyst
4 Exhaust gases and combustible constituents
5 Baffled mixing chamber (combines exhaust gases and fresh ambient air)
6 Lower distribution chamber (evenly dispenses hot or heated air)
7 Hot or heated air stream
8 Moist or damp surface
9 Exhaust tubing or piping
10 Blower air tubing or duct
11 Combined/mixed air streams 4 and 13 and, optionally, 12
12 Pressurized air flow or venturi flow
13 Ambient blower air stream
14 Perforated bottom plate
15 Catalytic chamber

DETAILED DESCRIPTION OF THE PREFERRED EMBODIMENTS

Figure 2:
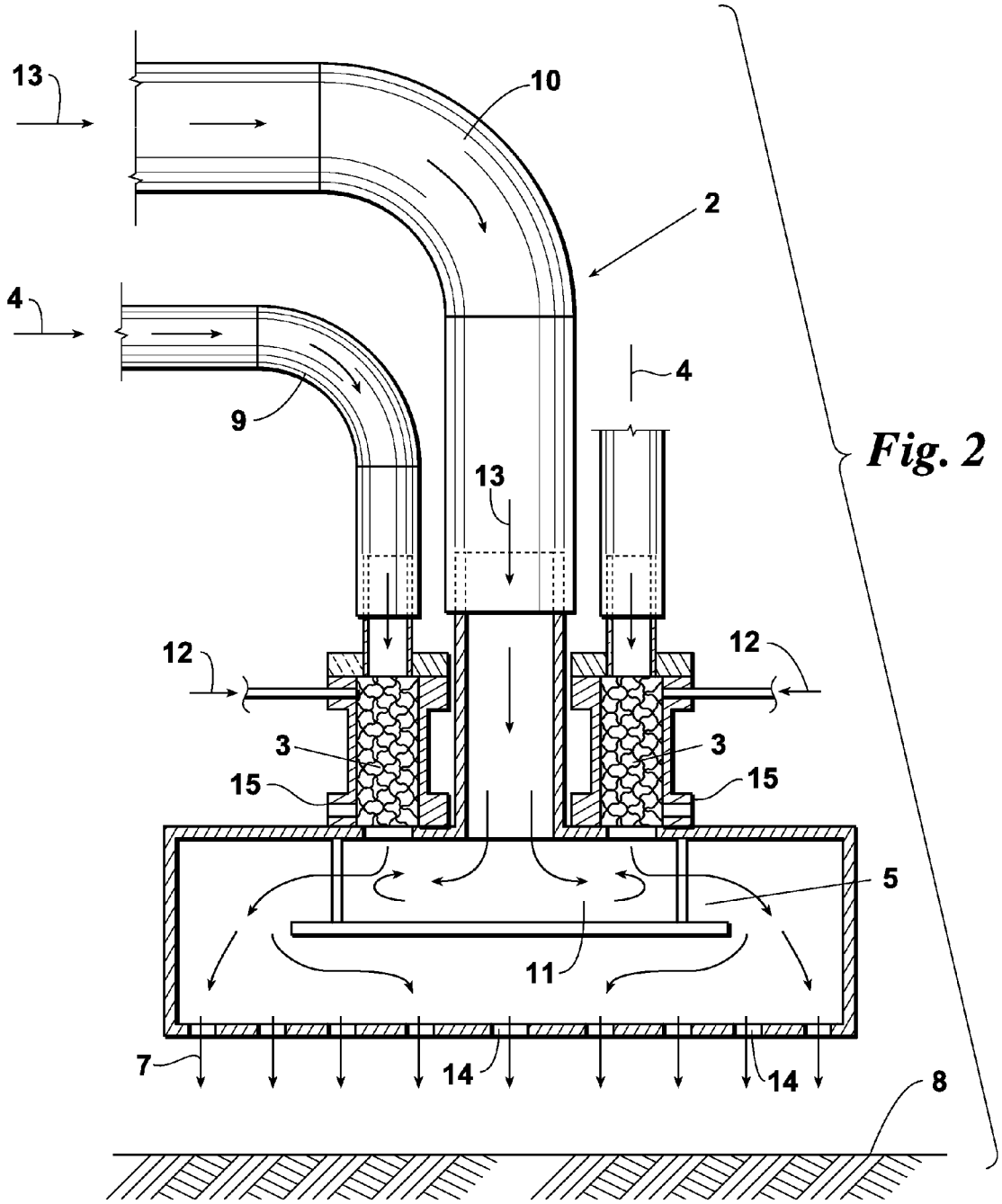
FIG. 2 is a cross-section side view of a catalytic heat distribution chamber with multiple catalyst placements.
Figure 3:
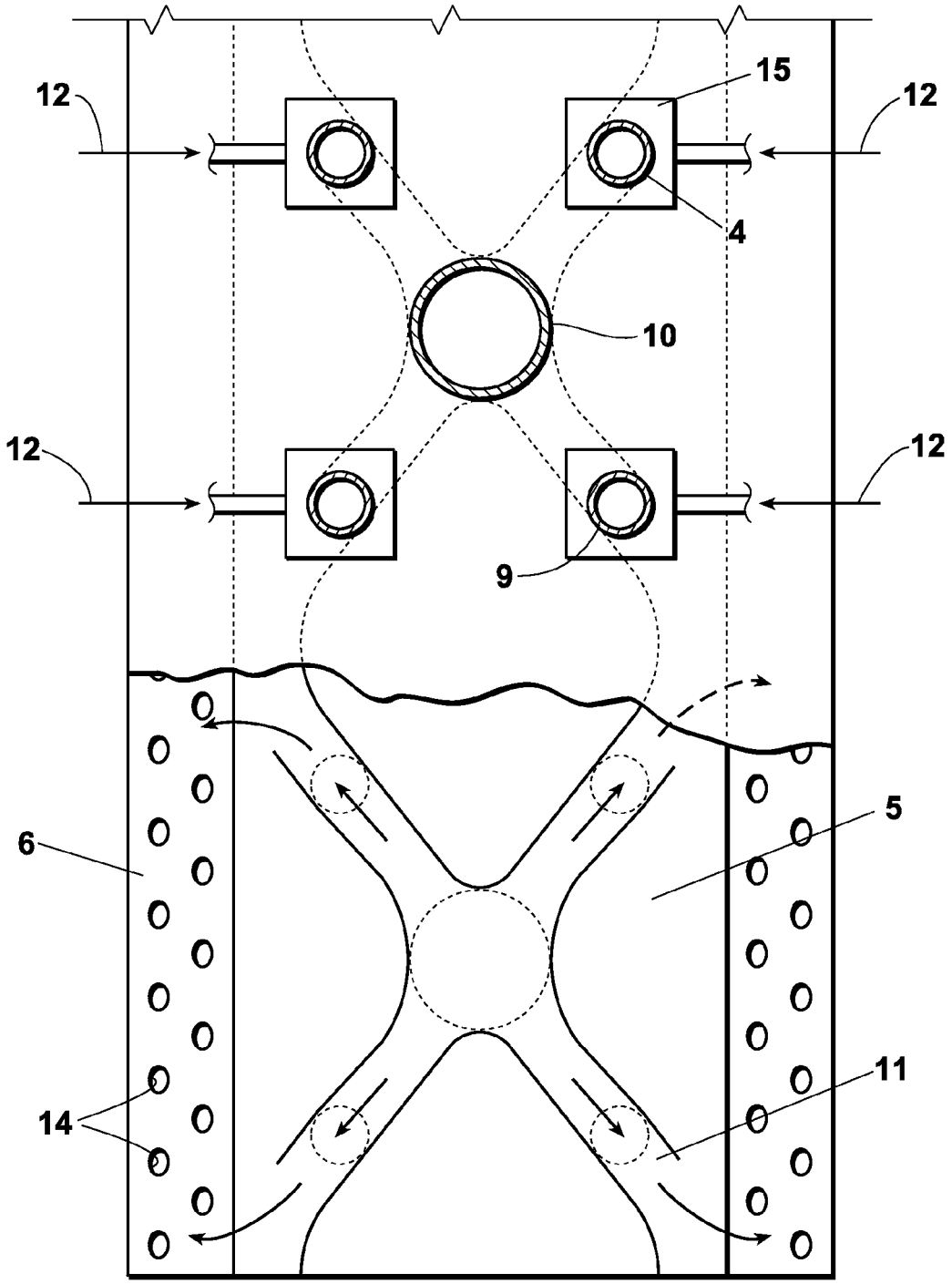
FIG. 3 is a partial cut-away top view of the catalytic heat distribution chamber with multiple catalyst placements.

Referring to FIGS. 1 to 3, preferred embodiments of an engine exhaust-driven heating device include a dual catalytic heater plenum 1 arrangement (see FIG. 1) and a multiple catalytic heater plenum 2 arrangement (see FIGS. 2 & 3). In each embodiment, a catalytic chamber 15, which is in communication with an exhaust piping 9 of an engine (not shown), houses a catalyst 3 through which an exhaust stream 4 is passed. The exhaust stream 4, which is preferably from an air-cooled, gasoline-fueled engine, can be mixed ahead of catalyst 3 with a secondary stream of pressurized air 12 (preferably at approximately 1 psi). An ambient air stream 13 from a blower (not shown) passes through blower tubing 10.

The two streams—ambient air stream 13 and either catalytic treated exhaust stream 4 or catalytic treated exhaust stream 4 with pressurized air stream 12—meet in baffled mixing chamber 5 as combined stream 11 where additional reaction occurs, breaking down remaining constituents in the exhaust stream 4 and releasing additional heat in the process. Stream 11 is then passed into distribution chamber 6 where the hot air or gas flow 7 exits the perforated bottom plate 14 of the chamber 6. The hot gas flow 7 then comes into contact with a moist surface 8, dissipating moisture and drying the surface 8.

Catalyst 3 converts constituents of the exhaust stream 4 (such as carbon monoxide, unburned or partially burned hydrocarbons from the fuel) and liberates heat as a result. Additional reaction occurs after the catalytic treated exhaust stream 4 meets the ambient air stream 13 in baffled mixing chamber 5, burning any remaining carbon monoxide and hydrocarbons and liberating heat. A suitable catalyst is an engine emission control catalyst provided by Catalytic Combustion Corporation (Bloomer, Wis.).

An air cooled engine is preferred because, to best manage the heat liberated by the combustion of fuel in the cylinders, an air-cooled engine runs in a fuel-rich condition and prevents perfect stoichiometric combustion. The fuel-rich condition limits the amount of heat released by the combustion reaction without sacrificing too much of the power generated when the fuel/air mixture ignites. Fuel-rich conditions also produce less nitrogen oxides by limiting the amount of oxygen in the cylinder which, in turn, keeps the combustion temperature lower. Lower temperature inhibits the temperature-dependent chemical reactions that produce nitrogen oxides. However, running an engine in a fuel-rich condition results in the exhaust containing more carbon dioxide and unburned hydrocarbons compared to engines which run closer to the stoichiometric point or optimum lean fuel mixture.

Catalyst 3 is operated to optimize the generation of heat available through the chemical conversion of unburned or partially burned fuel, carbon monoxide, and nitrogen oxides that are present in the exhaust stream 4. Because the engine is preferably run in a fuel-rich condition, the introduction of more oxygen is needed so that the catalyst 3 can initiate the chemical reactions. This can be done by injecting a pressurized air stream 12 prior to the catalyst 3. Pressurized air stream 12 can be a pure oxygen stream.

Introducing additional oxygen prior to a catalyst is not typically done in engine applications because of the need to control nitrogen oxide. The additional oxygen leads to higher temperatures which enable the production of nitrogen oxide.

In applications where the heating device, using an air cooled engine, is running in a confined space and build-up of carbon monoxide gas is to be avoided, the engine may be run less fuel rich (i.e., leaner) or pressurized air stream 12 may be injected ahead of the catalyst to provide more oxygen for additional stoichiometric combustion (further reducing harmful toxic emissions). Catalyst 3 may be applied in series a minimum of two to three times within the exhaust system to provide an operator-safe atmosphere.

Pressurized air stream 12 should be such that it draws in just enough air to permit the catalyst 3 to convert sufficient carbon monoxide to satisfy applicable government regulations. The engine should be adjusted to optimize its heat generating performance and excess air 13 is introduced in the baffled mixing chamber 5 (or injected ahead of the catalyst at 12) to combine surplus oxygen with the exhaust stream 4. This permits catalyst 3 to convert a substantial amount of the exhaust constituents in the exhaust stream 4 and significantly boost the temperature of the catalytic treated exhaust steam 4 when it flows into the baffled mixing chamber 5. In chamber 5, a self-initiating thermal reaction completes the combustion of any remaining residual combustible constituents.

Catalyst 3 could be sized so overall conversion of the carbon monoxide and hydrocarbons takes place in the catalyst 3, thereby liberating all of the heat in a single step or stage. However, this approach would raise the temperature of the catalyst 3 to a level beyond the point of thermal stability, resulting in degradation of the amount of heat generated over time and a significant shorting of the catalyst lifespan. Therefore two to three catalytic treatment stages of the exhaust constituents are preferred.

By way of example, a prototype system was built using a 25 hp Subaru v-twin engine model EH72.2. The following temperature profiles were recorded:

| | |
|---|---|
| Catalyst Inlet | 900° F. (482.2° C.) |
| Catalyst Outlet | 1,150° F. (621.1° C.) |
| Retention Chamber Outlet | 1,450° F. (787.8° C.) |

This engine exhaust and catalytic hot air stream supply, when integrated with the other necessary system components, can be used to dissipate and dry moisture from most hard surfaces; such as but not limited to concrete, asphalt, terrazzo, and other like surfaces, as well as compacted gravel and dirt.

Small apparatus—such as push- or self-propelled walk-behind devices designed to provide a drying area in a range of about 5 to 9 sq. ft. (0.46 to 0.84 $m^2$) and powered by a single internal combustion engine—could incorporate a dual catalytic heater plenum as shown in FIG. 1. Moderate-sized apparatus, such as a rider/operator controlled device designed to provide a drying area in a range of about 6 to 12 sq. ft. (0.56 to 1.11 $m^2$), could incorporate a quad- to dual-quad catalytic heater plenum (see e.g., FIGS. 2 & 3) with heat generated from two to four internal combustion engines. Large apparatus, such as a trailer-mounted or self-contained mobile system designed to provide a drying area in a range of about 16 to 30 sq. ft. (1.49 to 2.8 $m^2$), can be powered by up to eight internal combustion engines and have a large catalytic heat chamber with multiple catalyst placements to disperse the hot or heated air.

Any combination of internal combustion engines, including those in which multiple engines are incorporated, can be powered to accommodate a range of temperature requirements. Regardless of device size, the invention has the ability to divert the heated air flow through a single, manually operated drier wand for isolated or discrete application needs. A single catalytic heater plenum and distribution chamber via a flexible conduit can be utilized for this purpose.

The invention is also not limited to surface drying applications. The heat generated from the free byproduct of combustion as a significant heat source lends itself to many other applications where a portable and flexible source of heat is required indoors or out including, but not limited to ice, snow, and stripping finishes.

What is claimed:

1. A portable heating system comprising:

a catalytic chamber (15) housing at least one catalyst (3) and arranged to receive an exhaust gas stream;

a baffled mixing chamber (5) arranged to receive a catalytic-treated exhaust gas stream from the catalytic chamber and mix the catalytic-treated exhaust gas stream with an ambient air stream; and a distribution chamber (6) arranged to receive a mixed gas stream from the baffled mixing chamber and direct it toward a surface to be dried.

2. A portable heating system according to claim 1 wherein the mixed gas stream has a higher temperature than the catalytic-treated exhaust gas stream.

3. A portable heating system according to claim 1 further comprising a pressurized air source (12) arranged in communication with the catalytic chamber.

4. A portable heating system according to claim 3 wherein the pressurized air source is arranged to inject pressurized air ahead of the at least one catalyst.

5. A portable heating system according to claim 3 wherein the pressurized air source is arranged to provide pressurized air containing a higher percentage of oxygen than the ambient air stream contains.

6. A portable heating system according to claim 1 wherein the mixed gas stream contains a lower overall level of undesired pollutants than the catalytic-treated exhaust gas stream contains.

7. A portable heating system according to claim 1 wherein the exhaust gas stream is produced by an engine operating in a fuel-rich condition.

8. A portable heating apparatus comprising:

a catalytic chamber (15) housing at least one catalyst (3) suitable for reducing a level of undesired pollutants present in an engine exhaust gas stream;

a baffled mixing chamber (5) arranged to receive a catalytic-treated exhaust gas stream from the catalytic chamber and an ambient air stream from an ambient air source (13); and a distribution chamber (6) arranged to receive a mixed gas stream from the baffled mixing chamber, the distribution chamber including means for directing a flow of the mixed gas stream toward a surface to be dried.

9. A portable heating apparatus according to claim 8 further comprising a pressurized air source (12) arranged in communication with the catalytic chamber.

10. A portable heating apparatus according to claim 9 wherein the pressurized air source is arranged to inject pressurized air ahead of the at least one catalyst.

11. A portable heating apparatus according to claim 9 wherein the pressurized air source is arranged to provide pressurized air containing a greater percentage of oxygen than the ambient air stream contains.

12. A portable heating apparatus according to claim 8 wherein the mixed gas stream contains a lower overall level of undesired pollutants than the catalytic-treated exhaust gas stream contains.

13. A portable heating apparatus according to claim 8 wherein the exhaust gas stream is produced by an engine operating in a fuel-rich condition.

14. A portable heating apparatus according to claim 8 wherein the means for directing a flow of the mixed gas stream is a perforated plate.

15. A portable heating apparatus according to claim 8 wherein the ambient air source is a blower.

16. A method for removing an undesired layer of material residing immediately above a desired base layer of material, the method comprising the steps of:

passing an engine exhaust gas stream through a catalytic chamber (15) housing at least one catalyst (3), the catalyst being suitable for reducing a level of undesired pollutants present in the engine exhaust gas stream;

mixing a catalytic-treated exhaust gas stream from the catalytic chamber with an ambient air stream from an ambient air source (13), the mixing step taking place in a baffled mixing chamber (5); and distributing a mixed gas stream from the baffled mixing chamber toward the undesired layer of material;

wherein the mixed gas stream has a higher temperature than the catalytic-treated exhaust gas stream and the catalytic-treated exhaust gas stream has a higher temperature than the engine exhaust gas stream; and wherein the mixed gas stream has an overall lower level of undesired pollutants than does the catalytic-treated exhaust gas stream.

17. A method according to claim 16 further comprising the step of injecting pressurized air into the engine exhaust gas stream.

18. A method according to claim 17 wherein the injecting step occurs ahead of the at least one catalyst.

19. A method according to claim 17 wherein the pressurized air contains a greater percentage of oxygen than the ambient air stream contains.

* * * * *